US007416031B2

(12) United States Patent
Murakami et al.

(10) Patent No.: US 7,416,031 B2
(45) Date of Patent: Aug. 26, 2008

(54) IMPACT TOOL

(75) Inventors: Takuhiro Murakami, Ibaraki (JP); Junichi Kamimura, Ibaraki (JP); Katsuhiro Oomori, Ibaraki (JP); Shinki Ohtsu, Ibaraki (JP); Hiroto Inagawa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/399,442

(22) Filed: Apr. 7, 2006

(65) Prior Publication Data

US 2006/0254789 A1 Nov. 16, 2006

(30) Foreign Application Priority Data

Apr. 11, 2005 (JP) ..... P2005-113049

(51) Int. Cl.
*B25D 17/11* (2006.01)

(52) U.S. Cl. ..... 173/211; 173/93.5; 173/109; 173/128

(58) Field of Classification Search ..... 173/210, 173/93, 93.5, 109, 128, 178, 211, 176
See application file for complete search history.

(56) References Cited

U.S. PATENT DOCUMENTS 3,837,179 A * 9/1974 Barth ..... 464/76
4,779,470 A * 10/1988 Morita et al. ..... 74/7 R
4,811,797 A * 3/1989 Antipov et al. ..... 173/93.6
5,601,149 A * 2/1997 Kawasaki et al. ..... 173/93.5
5,873,786 A * 2/1999 Hosoya et al. ..... 464/73
5,992,538 A * 11/1999 Marcengill et al. ..... 173/93
6,158,526 A * 12/2000 Ghode et al. ..... 173/93
6,223,834 B1 * 5/2001 Takamura et al. ..... 173/93.5
6,457,535 B1 * 10/2002 Tanaka ..... 173/48
6,863,135 B2 * 3/2005 Kamimura et al. ..... 173/216
7,048,075 B2 * 5/2006 Saito et al. ..... 173/93.5
2001/0000882 A1 5/2001 Giardino et al.
2002/0121384 A1 * 9/2002 Saito et al. ..... 173/109

FOREIGN PATENT DOCUMENTS

JP 07-237152 9/1995
JP 2002-254335 9/2002

* cited by examiner

*Primary Examiner*—Scott A. Smith
(74) *Attorney, Agent, or Firm*—Mattingly, Stanger, Malur & Brundidge, P.C.

(57) ABSTRACT

An impact tool comprising a motor, a hammer 8 that is rotated and axially moved by a drive force of the motor, an anvil 3 that repeats engagement/disengagement from the hammer 8 accompanying rotation and axial movements of the hammer 8, and a tip tool 4 mounted to the anvil 3, the anvil 3 comprising a first split piece 3A, which includes pawls 3*c* (first concave-convex part) on an opposite side to the hammer and repeats engagement/disengagement from the hammer 8, a second split piece 3B, which includes pawls 3*f* (second concave-convex part) engageable with the pawls (first concave-convex part) 3*c* of the first split piece 3A in a direction of rotation, and to which the tip tool 4 is mounted, and a rubber damper (elastic body) 13 interposed between the first and second split pieces 3A, 3B to prevent direct contact between the pawls (first concave-convex part) 3*c* and the pawls (second concave-convex part) 3*f* in the direction of rotation and in an axial direction.

5 Claims, 6 Drawing Sheets

IMPACT TOOL

CROSS-REFERENCE TO RELATED APPLICATIONS

This application is based on and claims the benefit of priority from the prior Japanese Patent Application No. 2005-113049, filed on Apr. 11, 2006; the entire contents of which are incorporated herein by reference.

TECHNICAL FIELD

The present invention relates to an impact tool that generates a rotary impact force to perform a required work such as thread fastening, etc., and more particular, to an impact tool that achieves reduction in noise.

BACKGROUND

An impact tool being a configuration of a power tool generates a rotary impact force with a motor as a drive source to rotate a tip tool to intermittently give an impact force thereto to perform a work such as thread fastening, etc., and is presently used widely since the impact tool has a feature in that reaction is small, a clamping capacity is high, and so forth. Since such impact tool includes a rotary impact mechanism to generate a rotary impact force, however, noise while working is large to cause a problem.

FIG. 12 shows a longitudinal cross section of a general impact tool used conventionally.

The conventional impact tool shown in FIG. 12 comprises a cell pack 1 as an electric source, and a motor 2 as a drive source, and drives a rotary impact mechanism part to give rotation and impact to an anvil 3, thereby intermittently transmitting a rotary impact force to a tip tool 4 to perform a work such as screwing, etc.

In the rotary impact mechanism part built in a hammer casing 5, rotation of an output shaft (a motor shaft) of the motor 2 is reduced in speed through a planetary gear mechanism 6 to be transmitted to a spindle 7, so that the spindle 7 is rotationally driven at a predetermined speed. Here, the spindle 7 and a hammer 8 are connected to each other by a cam mechanism, the cam mechanism comprising a V-shaped spindle cam groove 7*a* formed on an outer peripheral surface of the spindle 7, a V-shaped hammer cam groove 8*a* formed on an inner peripheral surface of the hammer 8, and balls 9 that engage with the cam grooves 7*a*, 8*a*. Also, the hammer 8 is constantly biased toward a tip end (rightward in FIG. 12) by a spring 10, and positioned with a clearance from an end surface of the anvil 3 by means of engagement of the balls 9 and the cam grooves 7*a*, 8*a* when being stationary. Projections, respectively, are formed symmetrically in two locations on opposite rotary flat surfaces of the hammer 8 and the anvil 3. In addition, a screw 11, the tip tool 4, and the anvil 3 are constrained relative to one another in a direction of rotation. Also, in FIG. 12, the reference numeral 14 denotes a bearing metal that bears the anvil 3 rotatably.

As described above, when the spindle 7 is rotationally driven, rotation thereof is transmitted to the hammer 8 through the cam mechanism, and the projection on the hammer 8 engages with the projection on the anvil 3 to rotate the anvil 3 before the hammer 8 makes a half revolution, but when relative rotations are generated between the hammer 8 and the spindle 7 by reaction forces of the engagement, the hammer 8 begins to retreat toward the motor 2 while compressing the spring 10 along a spindle cam groove 7*a*. When backward movement of the hammer 8 causes the projection on the hammer 8 to get over the projection on the anvil 3 to release engagement of the both, the hammer 8 is quickly accelerated in a direction of rotation and forward owing to elastic energy accumulated in the spring 10 and the action of the cam mechanism in addition to torque of the spindle 7 to be moved forward by the bias of the spring 10, and the projection thereon engages again with the projection on the anvil 3 to begin to rotate together. At this time, since a large rotary impact force is applied to the anvil 3, the rotary impact force is transmitted to the screw 11 through the tip tool 4 mounted to the anvil 3.

Thereafter, the same actions are repeated, the rotary impact force is intermittently and repeatedly transmitted to the screw 11, and the screw 11 is screwed into a timber 12 being a clamped object.

By the way, since the hammer 8 makes longitudinal movements simultaneously with rotary movements in a work, in which such impact tool is used, these movements serve as a source of vibration to axially vibrate the timber 12, being a clamped object, through the anvil 3, the tip tool 4, and the screw 11 to generate a large noise.

Here, it is found that a noise energy from an object being clamped accounts for a large ratio in noise while working with the use of an impact tool, it is required that a vibration force transmitted to an object being clamped be restricted to a small extent in order to achieve reduction in noise, and various measures have been examined (see, for example, JP-A-7-237152 and JP-A-2002-254335).

SUMMARY

JP-A-7-237152 describes that an anvil is divided into two members, a torque transmission part is formed between the both members, and a cushioning material is provided in an axial clearance to decrease axial forces acting on a tip tool and a screw to reduce noise. Here, a rectangular-shaped recess is formed on one of the both members, a rectangular-shaped projection is formed on the other of the both members, and the torque transmission part is formed to be rectangularly concave and convex, spline-shaped, and so forth to connect the both members to each other in a non-rotatable manner.

When torque is applied to the torque transmission part, however, a large frictional force is generated between the both members and such frictional force obstructs axial, relative movements of the both members, so that axial forces acting on a tip tool and a screw cannot be made very small and thus an effect of reduction in noise is insufficient.

JP-A-2002-254335 describes that a torque transmission part is provided by engagement of a key element, which comprises a part such as a ball, a roller, etc., and grooves provided on both members, which are provided by dividing an anvil into two halves, whereby an axial frictional force between the both members is decreased.

With such construction, however, since bearing is very high at contact portions between the key element and the grooves, there is caused a problem that parts are worn early and the construction is complicated Lo lead to an increase in manufacturing cost.

The invention has been thought of in view of the problems and has its object to provide an impact tool, which solves the problems and is robust, small in noise, and inexpensive.

In order to attain the object, the invention according to claim 1 provides an impact tool, in which a rotary impact mechanism is mounted on a spindle rotationally driven by a motor and a rotary impact force generated by the rotary impact mechanism is intermittently transmitted to a tip tool through an anvil from a hammer to thereby be given to the tip tool, the impact tool comprising a cushioning mechanism provided on the anvil or the tip tool to fulfill a cushioning function in a direction of rotation and in an axial direction and to directly transmit torque of a set value or more.

The invention according to claim 2 adds to the invention according to claim 1 a feature that the cushioning mechanism is provided by dividing the anvil or the tip tool axially into two halves and interposing a damper between two split pieces to hold the both split pieces to make the same relatively movable in the direction of rotation and in the axial direction.

The invention according to claim 3 adds to the invention according to claim 2 a feature that axial and circumferential clearances are formed between the two split pieces of the anvil or the tip tool at the time of no load application and when torque at the time of load application exceeds a set value, the two split pieces contact circumferential with each other to directly transmit torque to the other of the split pieces from one of the split pieces.

The invention according to claim 1 provides an impact tool comprising a motor, a hammer that is rotated and axially moved by a drive force of the motor, an anvil that repeats engagement/disengagement from the hammer accompanying rotation and axial movements of the hammer, and a tip tool mounted to the anvil, and wherein the anvil comprises a first split piece, which includes a first concave-convex part on an opposite side to the hammer and repeats engagement/disengagement from the hammer, a second split piece, which includes a second concave-convex part engageable with the first concave-convex part of the first split piece in a direction of rotation, and to which the tip tool is mounted, and an elastic body interposed between the first and second split pieces to prevent direct contact between the first concave-convex part and the second concave-convex part in the direction of rotation and in an axial direction.

The invention according to claim 5 adds to the invention according to claim 4 a feature that when the first and second split pieces rotate relatively against the elastic force of the elastic body, the first and second concave-convex parts contact directly with each other.

According to the invention of claim 1, since the cushioning mechanism provided on the anvil or the tip tool fulfills a cushioning function both in a direction of rotation and in an axial direction, axial vibrations and rotary vibrations, which accompany an impact force, are absorbed and damped by the cushioning mechanism and in particular, axial vibrations from a rotary impact mechanism being a source of vibrations are suppressed in propagation to an object being clamped, so that reduction in noise is realized in the impact tool. Also, since the cushioning mechanism transmits torque of a set value or more directly, a decrease in clamping capacity is not incurred.

According to the invention of claim 2, since a damper interposed between the two divided halves of the anvil or the tip tool holds the both split pieces to make the same relatively movable in the direction of rotation and in the axial direction, axial vibrations and rotary vibrations, which accompany an impact force, are absorbed and damped by the elastic deformation of the damper and in particular, axial vibrations from a rotary impact mechanism being a source of vibrations are suppressed in propagation to an object being clamped, so that reduction in noise is realized in the impact tool.

According to the invention of claim 3, since when torque at the time of load application exceeds a set value, the both split pieces contact circumferentially with each other to directly transmit torque to the other of the split pieces from one of the split pieces, transmission of a large torque to the tip tool is enabled and breakage of the elastic body is prevented since elastic deformation of the damper is restricted.

According to the invention of claim 4, even when the hammer engages with the first split piece to generate a relative torque between the first and second split pieces, the elastic body prevents contact between the first and second split pieces, so that no frictional force is generated between the both split pieces. Therefore, when the first and second split pieces are about to make relative movements in the axial direction in a state, in which a relative torque is applied between the first and second split pieces, only reaction forces exerted by the elastic body obstruct such movements, thus enhancing the axial damping capacity. Consequently, axial vibrations transmitted to the second split piece from the first split piece become small and noise generated by a timber in, for example, a work of thread fastening for a timber, is made small. Accordingly, it is possible to provide an impact tool, which is robust, small in noise, and inexpensive.

According to the invention of claim 5, since when a relative torque between the first and second split pieces becomes large and deformation of the elastic body becomes large, the first and second split pieces contact directly with each other, deformation of the elastic body can be restricted to a certain limit. Thereby, it is possible to prevent breakage of the elastic body and to ensure a large clamping torque since loss of impact energy caused by elastic deformation of the elastic body is restricted to a small extent. Accordingly, accommodation to such a work as the clamping work of a bolt is enabled and the impact tool is enlarged in wide use in addition to the effect of the invention according to claim 4.

DESCRIPTION OF THE EMBODIMENTS

Embodiments of the invention will be described below with reference to the accompanying drawings.

Embodiment 1

Figure 1:
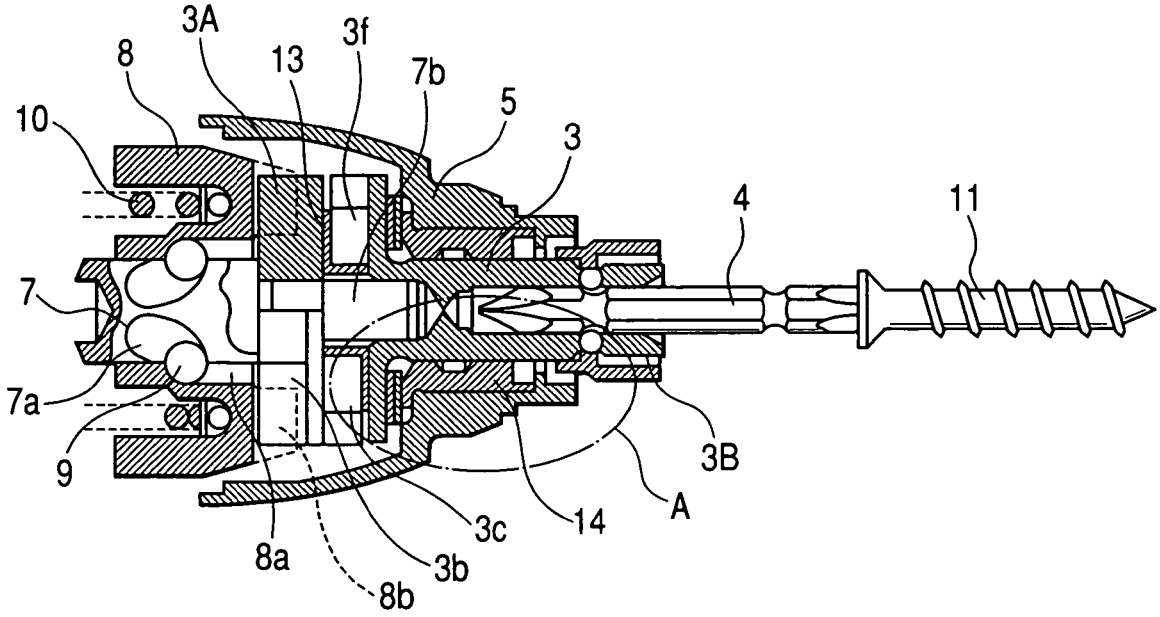
FIG. 1 is a longitudinal, cross sectional view showing a rotary impact mechanism part of an impact tool according to Embodiment 1 of the invention.
Figure 2:
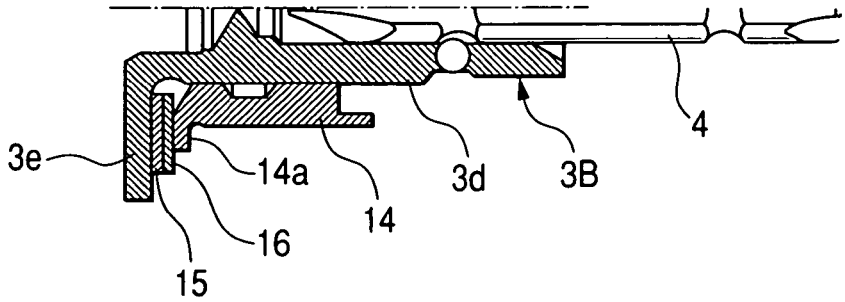
FIG. 2 is a view showing, in enlarged scale, details of a part A in FIG. 1.
Figure 3:
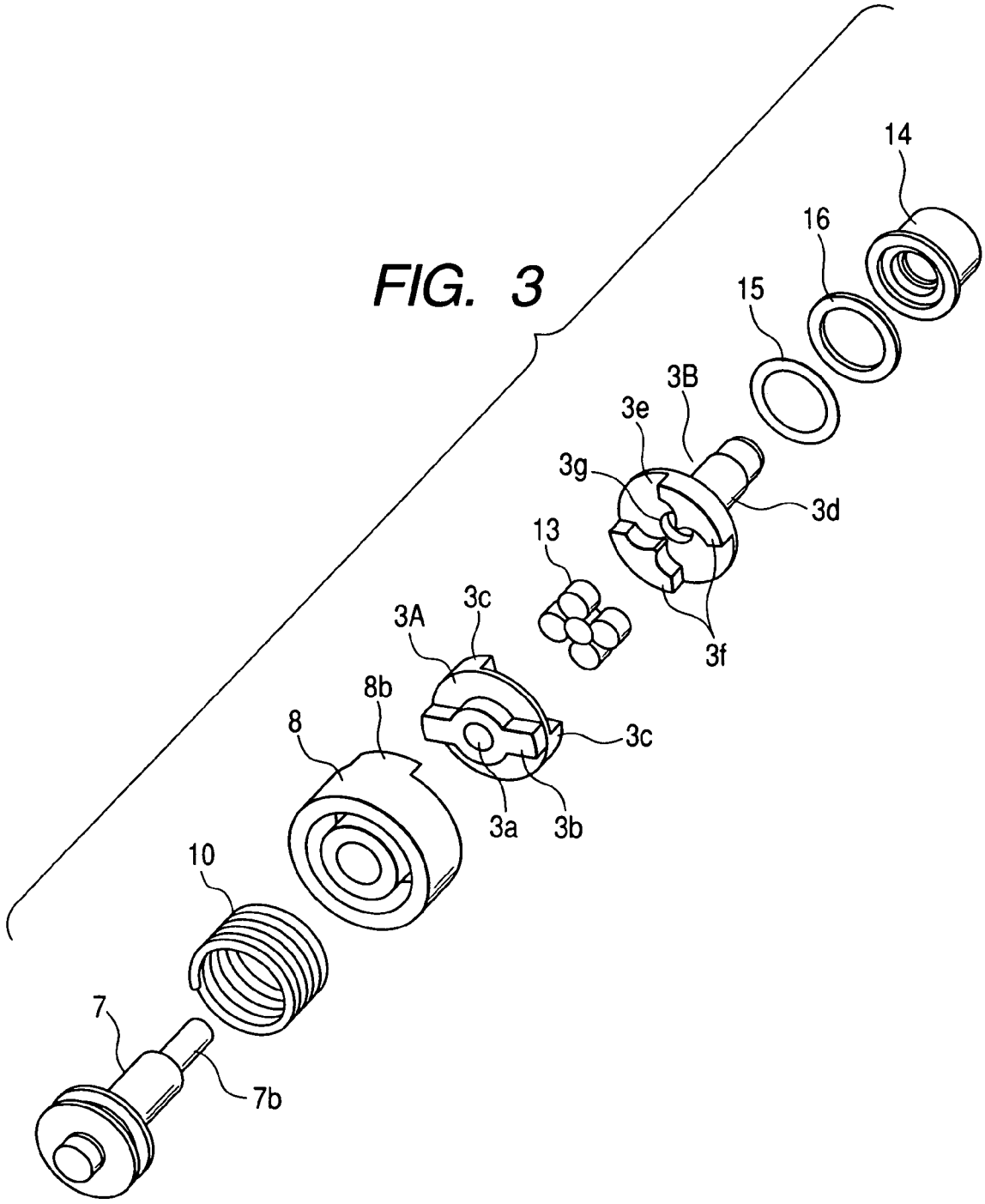
FIG. 3 is an exploded, perspective view showing the rotary impact mechanism part of the impact tool according to Embodiment 1 of the invention.
Figure 4:
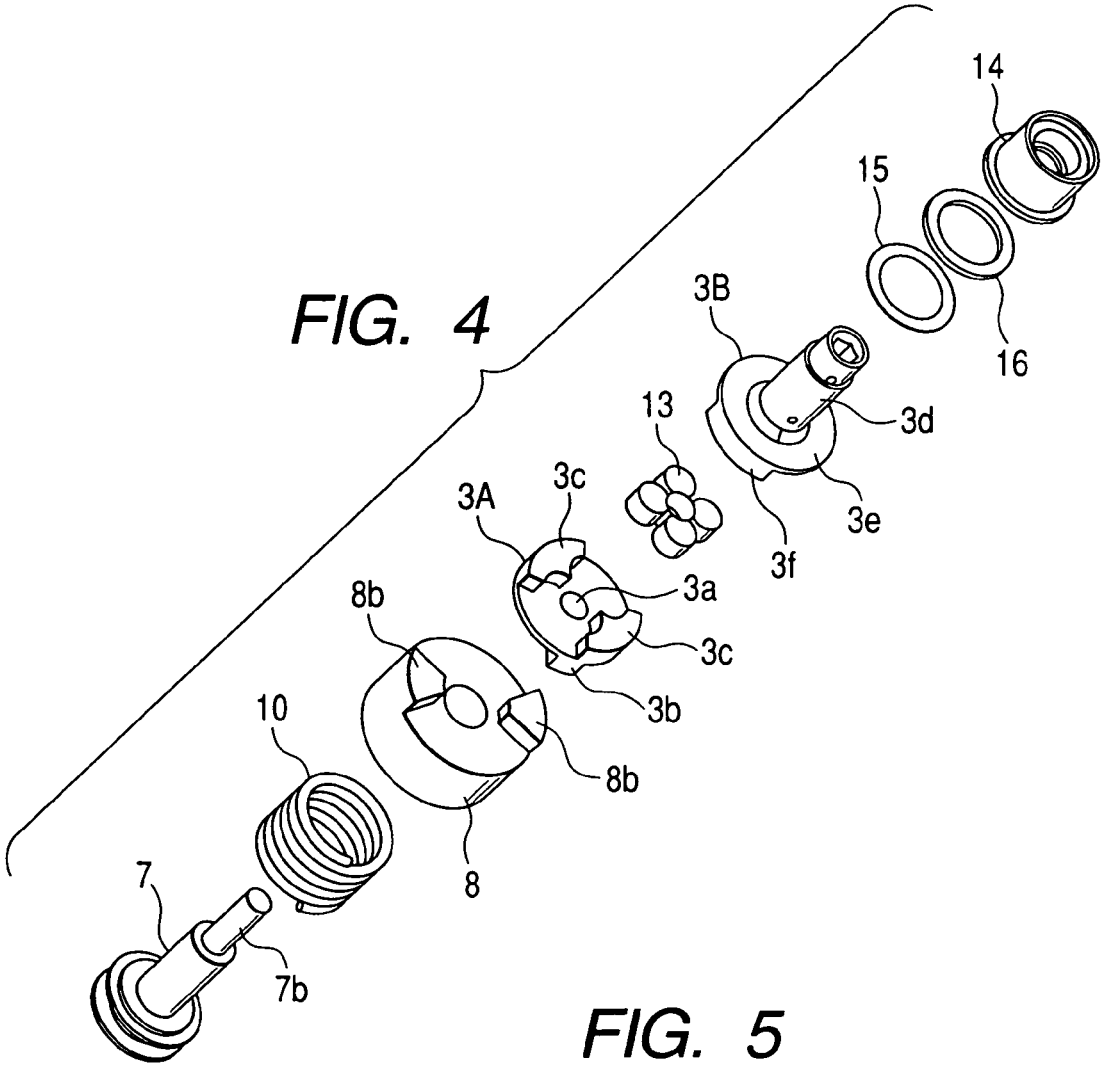
FIG. 4 is an exploded, perspective view showing the rotary impact mechanism part of the impact tool according to Embodiment 1 of the invention.
Figure 5:
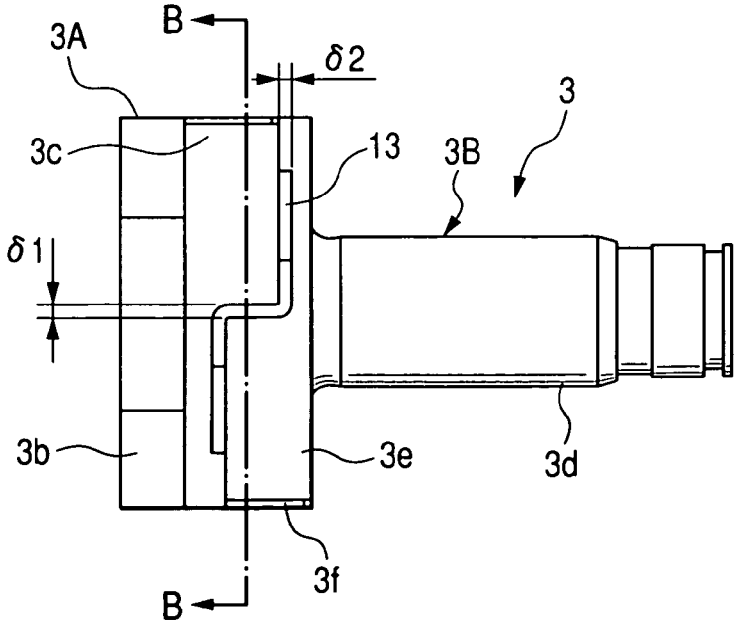
FIG. 5 is a side view showing an anvil of the impact tool according to Embodiment 1 of the invention.
Figure 6A:
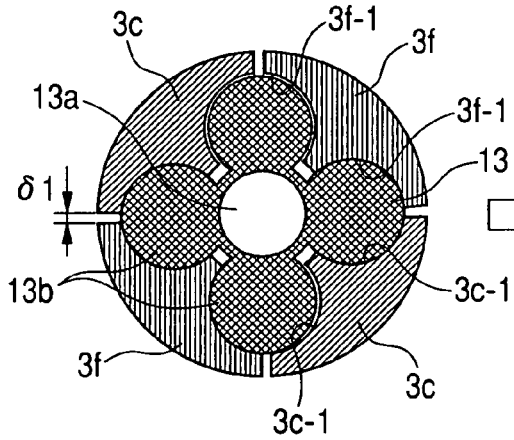
FIG. 6 is a cross sectional view taken along the line B-B in FIG. 5.
Figure 6B:
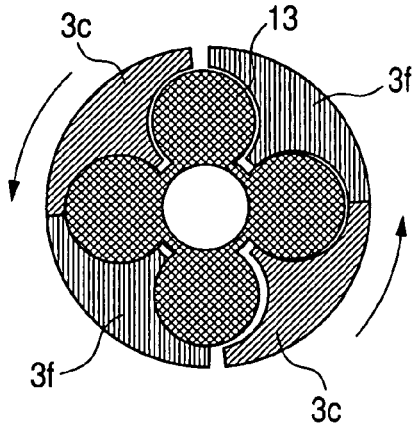

FIG. 1 is a longitudinal, cross sectional view showing a rotary impact mechanism part of an impact tool according to the Embodiment, FIG. 2 is a view showing, in enlarged scale, details of a part A, FIGS. 3 and 4 are exploded, perspective views showing the rotary impact mechanism part of the impact tool, FIG. 5 is a side view showing an anvil, and FIG. 6 is a cross sectional view taken along the line B-B in FIG. 5.

Figure 12:
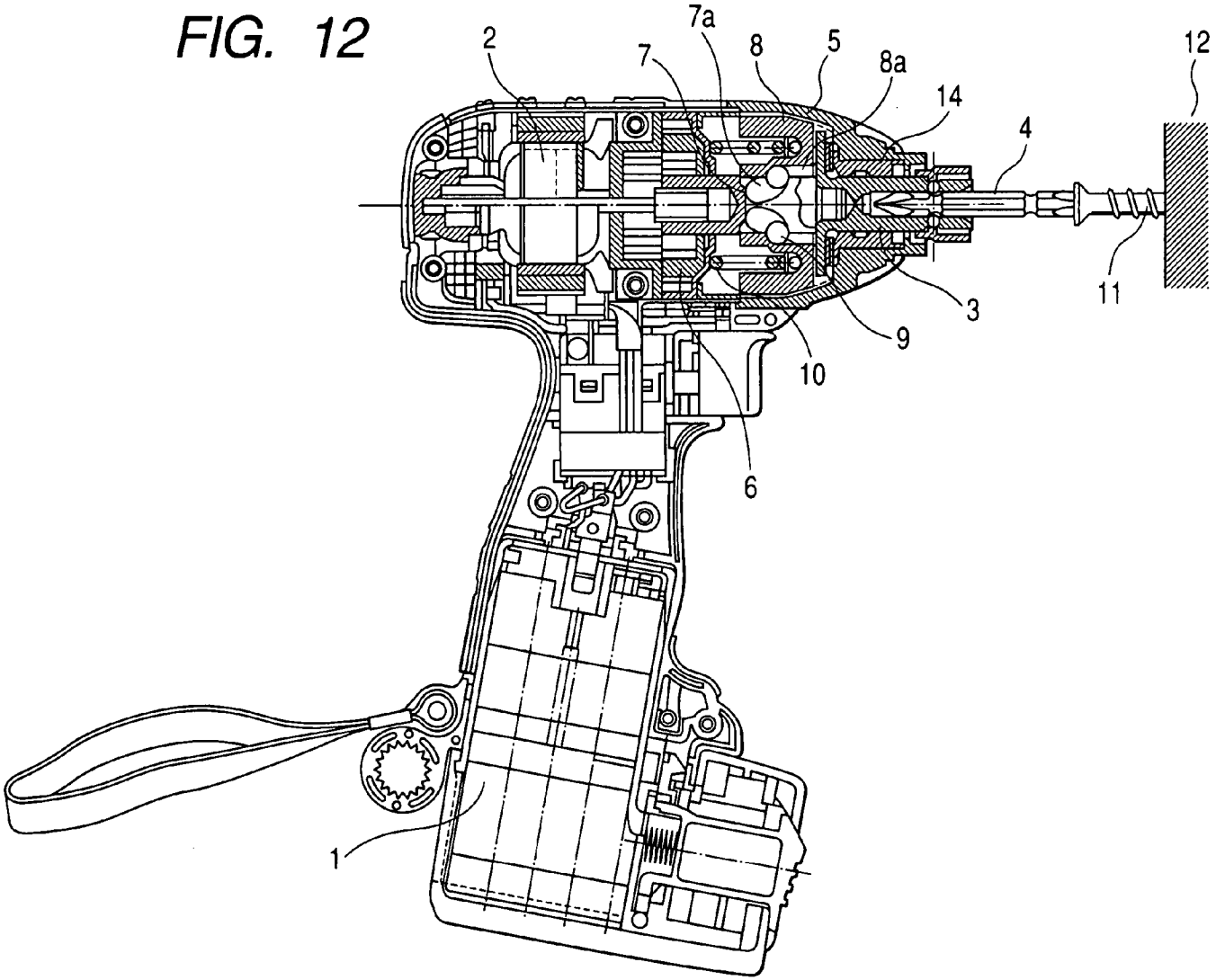
FIG. 12 is a longitudinal cross sectional view showing a conventional impact tool.

The impact tool according to the Embodiment is a cordless, portable type tool comprising a cell pack as an electric source, and a motor as a drive source, the construction thereof being the same as that of the conventional impact tool shown in FIG. 12 except a part thereof. Accordingly, a duplicate explanation is omitted for the same construction as that shown in FIG. 12, and an explanation will be given only to a characteristic construction of the invention.

The impact tool according to the Embodiment has a feature in the provision of a cushioning mechanism on an anvil 3. Here, the cushioning mechanism fulfills a cushioning function in a direction of rotation and in an axial direction, transits torque of a set value or more directly, and specifically comprises split pieces 3A, 3B provided by axially dividing the anvil 3 into two halves, and a rubber damper 13 as a cushioning material between the both split pieces 3A, 3B.

The rubber damper 13 acts also as an elastic body that prevents direct contact between a pawl 3*c* and a substantially disk-shaped end surface at a root of the pawl 3*c*, which define a first concave-convex part described later, and a pawl 3*f* and an end surface of a flange part 3*e* at a root of the pawl 3*f*, which define a second concave-convex part, in a direction of rotation and in an axial direction.

One 3A of the split pieces is molded to be substantially disk-shaped, and formed centrally thereof with a circular hole 3*a*. The split piece 3A is integrally formed on an end surface thereof toward the hammer 8 with a linear projection 3*b*, which passes through a center thereof as shown in FIG. 3, the hammer 8 is integrally formed on an end surface (an end surface opposed to the split piece 3A) thereof with two sector-shaped projections 8*b*, which are spaced an angle 180° in a circumferential direction from each other, as shown in FIG. 4, and the projections 8*b* and the projection 3*b* formed on the split piece 3A engage and disengage from each other intermittently every half revolution as described later. Also, the split piece 3A is integrally formed on the other end surface (an end surface opposed to the split piece 3B) thereof with two pawls 3*c*, which are spaced an angle 180° in a circumferential direction from each other, as shown in FIGS. 4 to 6, and the respective pawls 3*c* are formed with two arcuate recesses 3*c*-1 (see FIG. 6). In addition, a circular hole 8*c* is provided centrally of the hammer 8 to extend therethrough.

Here, since the projections 8*b* of the hammer 8 and the projection 3*b* of the split piece 3A repeatedly engage and disengage from each other as described later, the split piece 3A serves as a first split piece that repeats engagement and disengagement from the hammer 8. The first concave-convex part is defined by the pawl 3*c* and the substantially disk-shaped end surface at the root of the pawl 3*c*.

Also, the other 3B of the split pieces comprises a disk-shaped flange portion 3*e* formed integrally at one end of a hollow shaft portion 3*d* and extending in a direction perpendicular to an axis thereof, the flange portion 3*e* is integrally formed on an end surface (an end surface opposed to the split piece 3A) thereof with two pawls 3*f*, which are similar to the pawls 3*c* on the split piece 3A and spaced an angle 180° in a circumferential direction from each other as shown in FIGS. 3, 5, and 6, and the respective pawls 3*f* are formed with two arcuate recesses 3*f*-1 (see FIG. 6).

Here, the split piece 3B serves as a second split piece as opposed to the first split piece. The second concave-convex part is defined by the pawl 3*f* and the end surface of the flange portion 3*e* at the root of the pawl 3*f*.

Further, as shown in FIGS. 3, 4, and 6, the rubber damper 13 comprises four columnar-shaped damper pieces 13*b* arranged at circumferentially equiangular pitch (a pitch of 90 degrees) around a centrally formed circular hole 13*a* and formed integrally together.

Thus the anvil 3 is accommodated in the hammer casing 5 with the shaft portion 3*d* of the split piece 3B thereof being rotatably born by the bearing metal 14 as shown in FIG. 1, the other 3A of the split pieces is assembled to an end surface of the flange portion 3*e* of the split piece 3B with the rubber damper 13 therebetween so that the pawls 3*c*, 3*f* are arranged alternately in a circumferential direction as shown in FIG. 6, and the split piece 3A is supported by a tip end 7*b* of the spindle 7, which extends through the circular hole 3*a* formed centrally thereof, to be able to rotate and move axially relative to the split piece 3B. In addition, the tip end 7*b* of the spindle 7 extends through the circular hole 3*a* of the split piece 3A and the circular hole 13*a* of the rubber damper 13 to be fitted into a circular hole 3*g* of the other 3B of the split pieces.

Also, as shown in FIG. 2, a metal ring 15 for bearing of thrust and a rubber ring 16 are interposed between a back surface of the flange portion 3*e* of the split piece 3B of the anvil 3 and an end flange 14*a* of the bearing metal 14.

By the way, in a state, in which the anvil 3 is accommodated in the hammer casing 5 as described above, a space along an outward form of the rubber damper is defined by the pawls 3*c*, 3*f*, which are arranged alternately in a circumferential direction of the both split pieces 3A, 3B, and the rubber damper 13 is fitted into and accommodated in the space as shown in FIG. 6.

Thus, in a non-load state, in which any rotary impact force does not act on the anvil 3, a circumferential clearance δ1 and an axial clearance δ2 (see FIG. 5) are defined between the pawls 3*c*, 3*f* of the both split pieces 3A, 3B as shown in FIGS. 5 and 6(*a*).

The tip tool 4 is detachably mounted to the shaft portion 3*d* of the split piece 3B of the anvil 3, and the hammer 8 provided with the projections 8*b*, which engage and disengage from the projection 3*b* formed on an outer end surface of the split piece 3A, is constantly biased toward the anvil 3 (toward a tip end) by the spring 10.

Subsequently, an explanation will be given to an action of the impact tool constructed in the manner described above.

In the rotary impact mechanism part, rotation of an output shaft (a motor shaft) of the motor is reduced in speed through a planetary gear mechanism to be transmitted to the spindle 7, so that the spindle 7 is rotationally driven at a predetermined speed. In this manner, when the spindle 7 is rotationally driven, its rotation is transmitted to the hammer 8 through a cam mechanism, the projections on the hammer 8 engage with the projection 3*b* of the split piece 3A of the anvil 3 to rotate the split piece 3A before the hammer makes a half revolution.

When a reaction force (an engagement reaction force) accompanying engagement of the projections 8*b* of the hammer 8 and the projection 3*b* of the split piece 3A of the anvil 3 generates relative rotation between the hammer 8 and the spindle 7, the hammer 8 begins to retreat toward the motor while compressing the spring 10 along the spindle cam groove 7*a* of the cam mechanism. When backward movement of the hammer 8 causes the projections 8*b* of the hammer 8 to get over the projection 3*b* of the split piece 3A of the anvil 3 to release engagement of the both, the hammer 8 is quickly accelerated in a direction of rotation and forward owing to elastic energy accumulated in the spring 10 and the action of the cam mechanism in addition to torque of the spindle 7 to be moved forward by the bias of the spring 10, and the projections 8*b* thereof engage again with the projection 3*b* on the anvil 3 to begin to rotate the anvil 3. At this time, while a large rotary impact force is applied to the anvil 3, impact vibrations are absorbed and damped by axial elastic deformation of the rubber damper 13, which is caused by the impact force, since the anvil 3 is structured with the rubber damper 13 interposed between the two split pieces 3A, 3B and the axial clearance δ2 is defined between the both split pieces 3A, 3B as shown in FIG. 5.

According to the embodiment, the rubber damper 13 is interposed between the split piece 3A and the split piece 3B of the anvil 3 to prevent direct contact of the both split pieces 3A, 3B in the direction of rotation and in the axial direction, so that even when relative torque is generated between the both split pieces 3A, 3B, the rubber damper 13 eliminates contact between the both split pieces 3A, 3B and so no frictional forces are generated between the both. Accordingly, only reaction forces exerted by the rubber damper 13 upon elastic deformation of the rubber damper 13 obstruct axial relative movements of the both split pieces 3A, 3B, so that the anvil 3 is enhanced in axial damping capacity. Consequently, axial vibrations transmitted to the tip tool 4 become small and that noise generated by a timber, which accounts for a major part of noise in a work of thread fastening for a timber, is made small.

Also, when torque is applied to the anvil 3, the rubber damper 13 is elastically deformed, so that the both split pieces 3A, 3B rotate relatively. While torque remains small, a clearance is present between the pawls 3*c*, 3*f*, but when torque exceeds a certain value, the pawls 3*c*, 3*f* contact directly with each other as shown in FIG. 6(*b*), so that torque is transmitted directly to the split piece 3B from the split piece 3A. Thereby, even when torque increases, deformation of the rubber damper. 13 can be restricted to a certain limit and breakage of the rubber damper 13 can be prevented. Also, since loss of impact energy (kinetic energy) caused by elastic deformation of the rubber damper 13 is restricted to a small extent, it is possible to ensure a large clamping torque. Accordingly, accommodation to such a work as the clamping work of a bolt is enabled and the impact tool is enlarged in wide use.

In addition, since the rubber damper 13 act as a cushioning material in the direction of rotation of the both split pieces 3A, 3B, an impact sound generated upon collision of the pawls 3*c*, 3*f* becomes small. Therefore, not only sound discharged from timber but also noise discharged from the tool body is limited to a small degree.

Subsequently, the same actions are repeated and a rotary impact force is intermittently and repeatedly transmitted to the screw 11 from the tip tool 4, and the screw 11 is screwed into a timber being a clamped object.

Figure 7A:
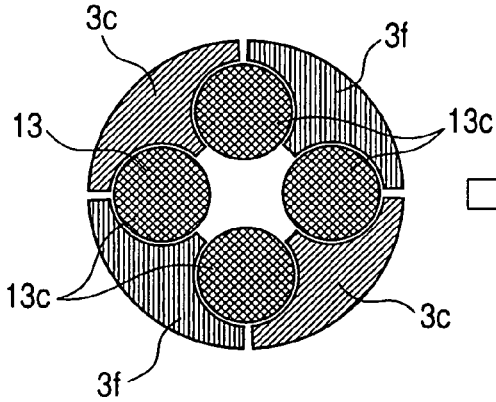
FIG. 7 is a view, similar to FIG. 6, showing a further configuration of a rubber damper.
Figure 7B:
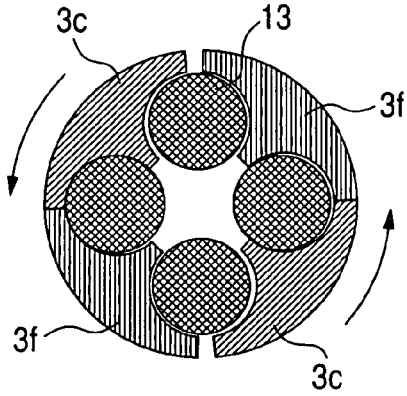
Figure 8A:
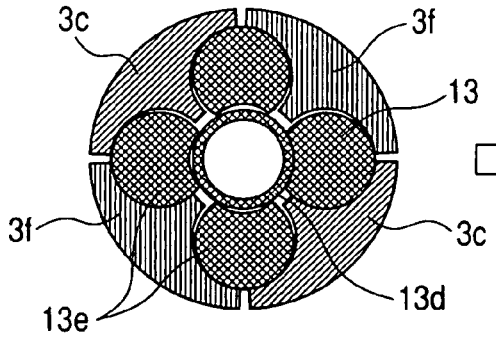
FIG. 8 is a view, similar to FIG. 6, showing a further configuration of a rubber damper.
Figure 8B:
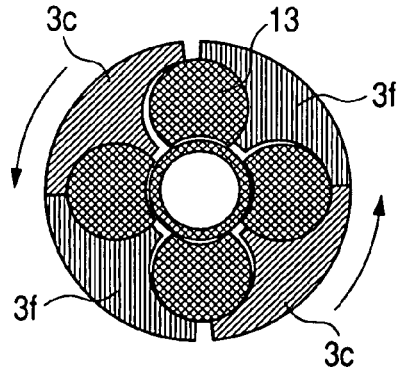
Figure 9A:
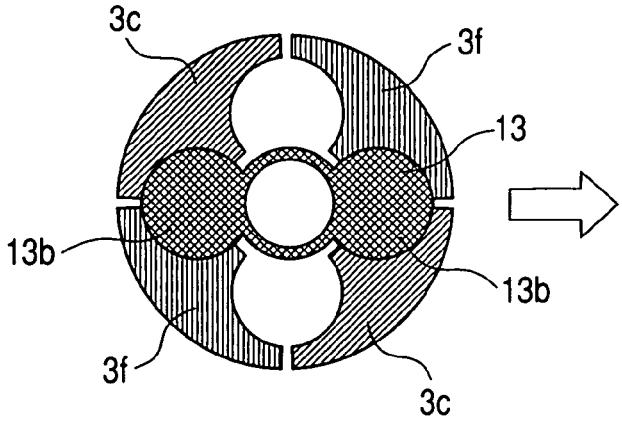
FIG. 9 is a view, similar to FIG. 6, showing a further configuration of a rubber damper.
Figure 9B:
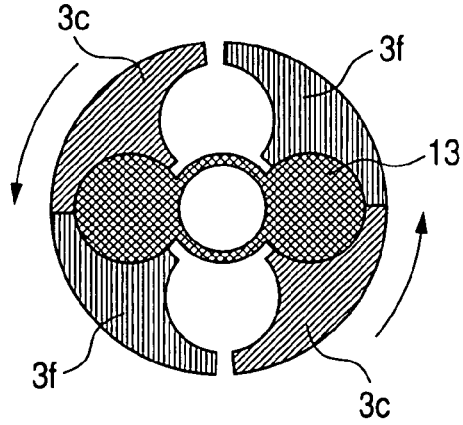

FIGS. 7 to 9, respectively, show various configurations of a rubber damper as a cushioning material. In addition, FIGS. 7 to 9 are the same as FIG. 6, (a) in the respective figures shows a non-load state, and (b) shows a load state, in which torque of a set value or more acts.

In a configuration shown in FIG. 7, a rubber damper 13 comprises four independent, columnar-shaped damper pieces 13*c*, and when torque of the split piece 3A of the anvil 3 exceeds a predetermined value, the respective damper pieces 13*c* of the rubber damper 13 are elastically deformed as shown in FIG. 7(*b*) to cause the pawls 3*c* of the split piece 3A to abut against (metallic contact) the pawls 3*f* of the split piece 3B, so that torque is transmitted directly to the other 3B of the split pieces from one 3A of the split pieces and the anvil 3 rotates integrally to transmit rotation to the tip tool 4. In this case, since the four damper pieces 13*c*, which form the rubber damper 13, are provided independently, it is possible to optionally set the damper pieces in stiffness (spring constant) to change the characteristic of the whole rubber damper 13 at need.

Also, in a configuration shown in FIG. 8, a rubber damper 13 comprises a central, sleeve-shaped damper piece 13*d* and four independent, columnar-shaped damper pieces 13*e* arranged around the damper piece, and when torque of the split piece 3A of the anvil 3 exceeds a predetermined value, the rubber damper 13 is elastically deformed as shown in FIG. 8(*b*) to cause the pawls 3*c* of one 3A of the split pieces to abut against (metallic contact) the pawls 3*f* of the other 3B of the split pieces, so that torque is transmitted directly to the other 3B of the split pieces from one 3A of the split pieces and the anvil 3 rotates integrally to transmit rotation to the tip tool 4. Also, in this case, since the one damper piece 13*d* and the four damper pieces 13*e*, which form the rubber damper 13, are provided independently, it is possible to optionally set the damper pieces in stiffness (spring constant) to change the characteristic of the whole rubber damper 13 at need.

Also, in a configuration shown in FIG. 9, columnar-shaped damper pieces 13*b*, which form a rubber damper 13, are reduced in number to be made two in number, and the damper pieces 13*b* are integrally arranged in symmetrical positions spaced an angle 180° in a circumferential direction, so that such arrangement can be suitably adopted, in particular, in the case where a large transmission torque is not necessary.

In addition, the rubber damper 13 used in the impact tool according to the invention suffices to fulfill a cushioning function both in a direction of rotation and in an axial direction, to prevent direct contact between the both split pieces 3A, 3B of the anvil 3 in the axial direction while the real machine operates, and to act so that when torque of a set value or more is applied, the pawl 3*c* of the split piece 3A contacts directly with the pawl 3*f* of the split piece 3B in the circumferential direction, and a suitable characteristic can be obtained by changing a thickness of the rubber damper 13 and angles of the pawls 3*c*, 3*f* of the split pieces 3A, 3B of the anvil 3 in conformity to product specifications. Also, in the case where any problem in terms of product specifications is not caused even when transmission torque is set to be low, angles of the pawls 3*c*, 3*f* of the both split pieces 3A, 3B may be increased to prevent direct contact also in the circumferential direction.

Embodiment 2

Figure 10:
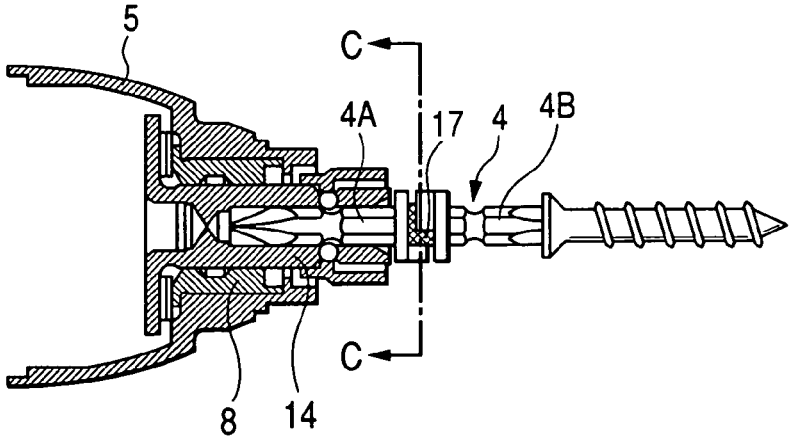
FIG. 10 is a longitudinal, cross sectional view showing a rotary impact mechanism part of an impact tool according to Embodiment 2 of the invention.

Subsequently, an explanation will be given to Embodiment 2 of the invention with reference to FIGS. 10 and 11. In addition, FIG. 10 is a longitudinal, cross sectional view showing a rotary impact mechanism part of an impact tool according to the Embodiment, and FIG. 11 is an enlarged, cross sectional view taken along the line C-C in FIG. 10, the same elements in these figures as those in FIGS. 1 and 2 are denoted by the same reference numerals as in the latter.

The impact tool according to the Embodiment has a feature in that a cushioning mechanism is provided on a tip tool 4. Here, the cushioning mechanism fulfills a cushioning function both in a direction of rotation and in an axial direction and directly transmits torque of a set value or more in the same manner as Embodiment 1, the cushioning mechanism specifically comprising split pieces 4A, 4B provided by axially dividing the tip tool 4 into two halves, and a rubber damper 17 interposed between the both split pieces 4A, 4B to act as a cushioning material.

Figure 11A:
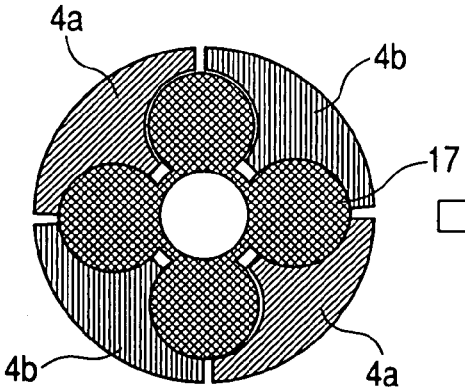
FIG. 11 is an enlarged, cross sectional view taken along the line C-C in FIG. 10.
Figure 11B:
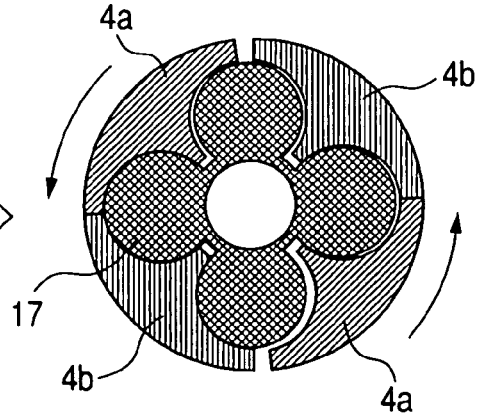

That is, as shown in FIG. 11, two pawls 4*a* are formed integrally on an end surface of the split piece 4A of the tip tool 4 in the same manner as Embodiment 1, and two similar pawls 4*b* are formed integrally on an end surface of the other 4B of the split pieces opposed to one of the split pieces. A rubber damper 17 is press-fitted in a space defined by the pawls 4*a*, 4*b* of the both split pieces 4A, 4B arranged alternately in a circumferential direction. In addition, the reason why the rubber damper 17 is press-fitted in the Embodiment is to prevent coming-off of the split piece 4B of the tip tool 4.

Thus, in the impact tool according to the Embodiment, since the cushioning mechanism provided on tip tool 4 fulfills a cushioning function both in a direction of rotation and in an axial direction, axial vibrations and rotary vibrations, which accompany an impact force, are absorbed and damped by the cushioning mechanism and in particular, axial vibrations from a rotary impact mechanism being a source of vibrations are suppressed in propagation to a timber, so that reduction in noise is realized.

Also, the cushioning mechanism causes the pawls 4*a* of the split piece 4A of the tip tool 4 to contact directly with the pawls 4*b* of the other 4B of the split pieces with respect to torque of a set value or more (see FIG. 11(*b*)), and the both split piece 4A, 4B are made integral to transmit torque of a set value or more directly to the screw 11 to rotate the same, so that a decrease in clamping capacity is prevented.

Accordingly, it is possible in the impact tool according to the Embodiment to realize reduction in noise without incurring a decrease in clamping capacity.

The invention is useful in application to an impact tool, such as hammer drill, etc, for generation of a rotary impact force to perform a required work and, in particular, achievement of reduction in noise.

What is claimed is:

1. An impact tool, comprising:

a motor;

a spindle being rotationally driven by a motor;

a tip tool;

a first anvil;

a second anvil;

a hammer, being mounted on the spindle, for generating a rotary impact force which is intermittently transmitted to the tip tool through the first and second anvils to thereby be given to the tip tool; and a cushioning mechanism provided between said first and second anvils to perform a cushioning function in a rotational direction and in an axial direction wherein in a first position of said first and second anvils, said cushioning mechanism biases said first and second anvils so that said first and second anvils do not directly engage each other, and wherein in a second position of said first and second anvils, when a torque is applied to said first anvil exceeding a predetermined value, said first and second anvils directly engage each other, thereby directly transmitting said torque from said first anvil to said second anvil.

2. The impact tool according to claim 1, wherein axial and circumferential clearances are formed between said first and second anvils at the time of no load applications, when the torque applied to said first anvil does not exceed the predetermined value, and wherein said first and second anvils directly contact each other at the circumferences of said first and second anvils to directly transmit torque from the first anvil to the second anvil at the time of load application, when the torque applied to the first anvil exceeds the predetermined value.

3. An impact tool comprising;

a motor;

a hammer being rotated and axially moved by a drive force of the motor;

first and second anvils, wherein the first anvil repeats engagement/disengagement from the hammer accompanying rotation and axial movements of the hammer;

a tip tool mounted to the second anvil, and wherein the first anvil includes a first concave part on an opposite side to the hammer and repeats engagement/disengagement from the hammer, wherein the second anvil includes a second concave part engageable with the first concave part of the first anvil in a direction of rotation, and to which the tip tool is mounted; and an elastic body being interposed between the first and second anvils to prevent direct contact between the first concave part and the second concave part in the direction of rotation and in an axial direction, wherein in a first position of said first and second anvils said elastic body biases said first and second anvils so that said first and second anvils do not directly engage each other, and wherein in a second position of said first and second anvils, when a torque is applied to said first anvil exceeding a predetermined value, said first and second anvils directly engage each other, thereby directly transmitting said torque from said first anvil to said second anvil.

4. The impact tool according to claim 3, wherein when the first and second anvils rotate relatively against the elastic force of the elastic body overcoming the elastic force, the first and second concave parts directly contact with each other.

5. An impact tool, comprising:

a motor;

a spindle being rotationally driven by a motor;

a tip tool;

an anvil;

a hammer, being mounted on the spindle, for generating a rotary impact force which is intermittently transmitted to the tip tool through the anvil to thereby be given to the tip tool; and a cushioning mechanism provided between said hammer and said anvil to perform a cushioning function in a rotational direction and in an axial direction, wherein in a first position of said hammer and said anvil, said cushioning mechanism biases said hammer and said anvil so that said hammer and said anvil do not directly engage each other, and wherein in a second position of said hammer and said anvil, when a torque is applied to said hammer exceeding a predetermined value, said hammer and said anvil directly engage each other, thereby directly transmitting said torque from said hammer to said anvil.

* * * * *